United States Patent [19]

Zifferer et al.

[11] 4,227,428

[45] Oct. 14, 1980

[54] THROTTLE SYNCHRONIZER FOR INTERNAL COMBUSTION ENGINES

[75] Inventors: Morton F. Zifferer; Donald E. Flinchbaugh, both of York, Pa.

[73] Assignee: Mordo Company, Mount Joy, Pa.

[21] Appl. No.: 4,015

[22] Filed: Jan. 17, 1979

[51] Int. Cl.[3] ..... G05G 5/04

[52] U.S. Cl. ..... 74/526; 74/527; 74/531; 74/565

[58] Field of Search ..... 74/526, 527, 531, 565; 123/98

[56] References Cited

U.S. PATENT DOCUMENTS

| | | | |
|---|---|---|---|
| 791,124 | 5/1905 | Baehr | 74/526 |
| 1,330,298 | 2/1920 | Baird | 74/526 X |
| 2,348,265 | 5/1944 | Rippingille | 74/526 |
| 3,199,368 | 8/1965 | Funk et al. | 74/526 |
| 3,452,616 | 7/1969 | Nelson et al. | 74/526 |

*Primary Examiner*—Allan D. Herrmann
*Attorney, Agent, or Firm*—Frailey & Ratner

[57] ABSTRACT

A throttle synchronizer for quickly and accurately setting and resetting each of the separate throttle valve control levers of plural internal combustion engines at a selected engine operating speed, with accurate and automatic synchronization of the engines at the selected lever setting. Adjustable throttle lever stops limit advance movement of the levers to the selected lever setting. The throttle lever stops are mounted on a transverse yoke, which is adjustable slidably relative to the paths of movement of the levers, so as to selectively locate the stops at any lever setting desired. The yoke is mounted slidably on a support located adjacent the levers, and a locking screw is utilized to secure the yoke in a selected position on the support. The throttle synchronizer is particularly useful on twin engine power boats having twin propellers, each driven by its own internal combustion engine.

9 Claims, 8 Drawing Figures

THROTTLE SYNCHRONIZER FOR INTERNAL COMBUSTION ENGINES

BACKGROUND OF THE INVENTION

In twin engine power boats having twin propellers, each driven by its own internal combustion engine, it is important, for proper maneuvering of the boat, to ensure that the two engines are in synchronism at all times. Further, if the engines are not synchronized, vibrations develop which are injurious to both the boat and the engines, and a highly unpleasant throbbing noise occurs.

In twin engine boats, there conventionally is provided a transversely spaced pair of throttle valve control levers, mounted pivotally relative to a throttle lever housing, each lever controlling the throttle valve for one of the engines. The levers are selectively advanced manually, relative to the housing, to cause the engines to operate at various speeds, ranging from idle or slow speed through various cruising speeds up to maximum or full speed. At all engine speed settings, it is necessary that the two throttle valve control levers be maintained in synchronous engine settings relative to each other, for proper operation of the boat.

When a boat is operating at a selected cruising speed, the throttle valve control levers are permitted to remain in their selected advance position or setting as the boat cruises. When it is necessary to slow the boat down, the levers are retracted to reduce engine speed. When the throttle levers again are advanced, to restore the boat to cruising speed, it is necessary to resynchronize the throttles, by appropriate manipulation of their levers, when the levers are back in cruising position.

It frequently is necessary to reduce the speed of a boat from cruising speed to slow or idle speed many times during the course of a day, particularly when cruising along populated stretches of water, such as in marinas, or through crowded waterways, passing docks or other boats, etc. It is not unusual, in the course of cruising or crowded waterways, to be required to slow the speed of a boat as many as three hundred times a day. Each time that occurs, it is necessary, when resuming cruising speed, to meticulously reset the throttle levers to resynchronize the throttles, to ensure that the operating speed of the engines is uniform and in synchronism. This is a frustrating and wearying experience, even for experienced pilots. It is a very difficult experience for inexperienced pilots.

So far as is presently known, no moderately priced, dependable, easily installed mechanical throttle synchronizer has been developed to permit the throttle valve control levers of a twin engine power boat, after slowing down the speed of the boat, to be quickly and accurately restored to a selected boat cruising speed location with concomitant accurate and automatic resynchronization of the engines at the selected boat cruising speed. Stop mechanisms for limiting the range of movement of throttle levers are old per se, as illustrated by the following patents: U.S. Pat. Nos. 1,427,969, 1,458,013, 1,479,108, 2,348,265, 2,613,547, 3,199,368 and 3,452,616. But they are not directed to the problem of engine resynchronization of twin engine power boats, nor do they even recognize that problem.

SUMMARY OF THE INVENTION

The primary object of this invention is to provide a throttle synchronizer for plural internal combustion engines, which enables the separate throttle valve control levers to be quickly and accurately located at selected engine speed settings, with accurate and automatic synchronization of the engines.

A further object of the invention is to provide a throttle synchronizer for plural internal combustion engines in which adjustable stops are utilized to limit selectively and uniformly the advance of the throttle valve control levers to engine operating position.

A further object is to provide a throttle synchronizer for plural internal combustion engines in which the stops for the throttle valve control levers are selectively adjustable relative to the paths of movement of the levers, to accurately set the levers at a variety of selected operating positions.

A further object is to provide a throttle synchronizer for plural internal combustion engines which includes adjustments automatically operative to set the levers in synchronous engine settings relative to each other, when the levers are advanced to a selected engine operating position.

A further object is to provide a throttle synchronizer for multi-engine boats, where each engine is provided with a separate throttle valve control lever, in which adjustable throttle lever stops, mounted on a slidable yoke, permit the levers to be quickly and accurately returned to a selected boat cruising speed location, following a slow down in boat speed, with accurate and automatic synchronization of the engines at the selected boat cruising speed.

While the invention is particularly adaptable for use in connection with multi-engine boats, it is believed that the invention has wider application and is adaptable for use in many installations where multiple internal combustion engines are utilized.

Other objects and advantages of this invention will be readily apparent from the following description of preferred embodiments thereof, reference being had to the accompanying drawing.

DETAILED DESCRIPTION OF THE INVENTION

Figure 1:
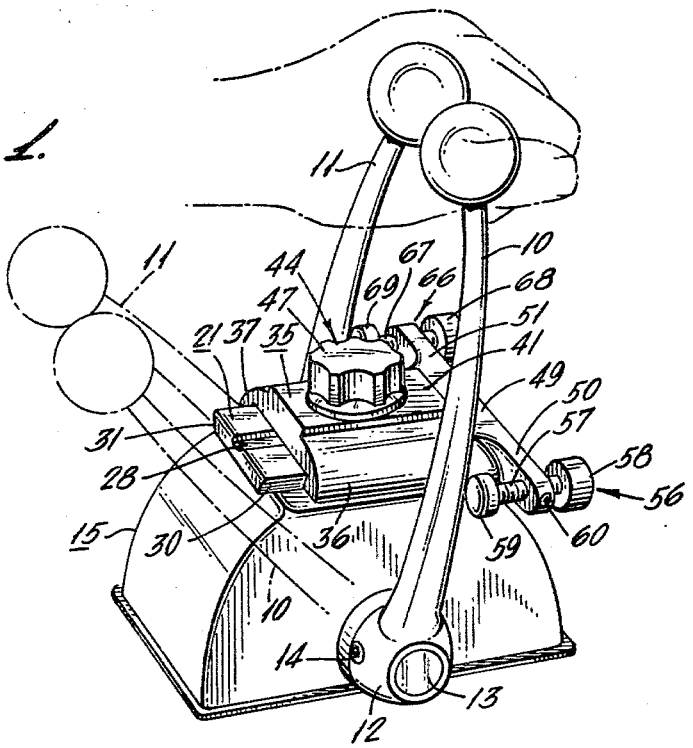
FIG. 1 is a perspective view of a preferred throttle synchronizer embodying this invention, the same being designed for use with a boat having twin propellers, each driven by a separate internal combustion engine.

The best mode of the invention as presently known is its utilization in connection with the throttle control levers for twin engine power boats having twin propellers, each driven by its own internal combustion engine.

Referring first to FIGS. 1–6 of the drawing, there is illustrated a preferred embodiment of the throttle synchronizer of this invention for use in connection with a pair of knobbed throttle valve control levers 10, 11 of conventional design. Throttle lever 10 is provided with a hub 12 which is secured to the outer end of a rotatable stud shaft 13 by means of an allen screw 14 or equivalent means. Shaft 13 extends inwardly of the usual throttle lever housing 15, by which the shaft is supported rotatably. The inner end (not shown) of the throttle lever shaft 13 is connected by conventional lever mechanism (also not shown) to the throttle valve of one of the engines for driving a boat.

In similar fashion, throttle lever 11 is provided with a hub 16 (FIG. 4) which is secured by an allen screw or other means (not shown) to rotatable stud shaft 17. Shafts 13, 17 are coaxial. The levers 10, 11 may be advanced and retracted pivotally or arcuately about the common axis of the shafts 13, 17 serving as a fixed point or location.

Figure 2:
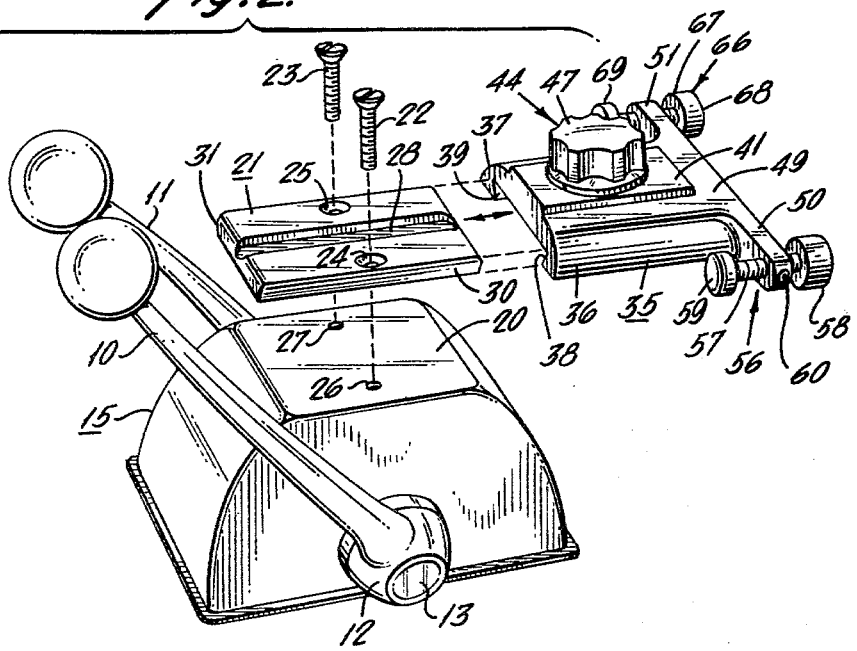
FIG. 2 is an exploded view in perspective of the throttle synchronizer illustrated in FIG. 1.

As best shown in FIG. 2, the throttle lever housing 15 is provided with a flat upper surface 20 to which is affixed a generally rectangular slide plate 21 by means of a pair of transversely spaced threaded bolts 22, 23. The threaded stems of the bolts 22, 23 extend through spaced apertures 24, 25 formed in plate 21, and engage threadingly within transversely spaced tapped holes 26, 27 formed in the upper housing surface 20. The upper surface of slide plate 21 is provided with an elongated, centrally disposed, longitudinal slot or groove 28. Preferably, the bottom of slot 28 is flat and smooth. The spaced longitudinal edges of the slide plate 21 are beveled so as to provide downwardly extending, inwardly sloping, smooth edges 30, 31 (FIG. 6).

Figure 6:
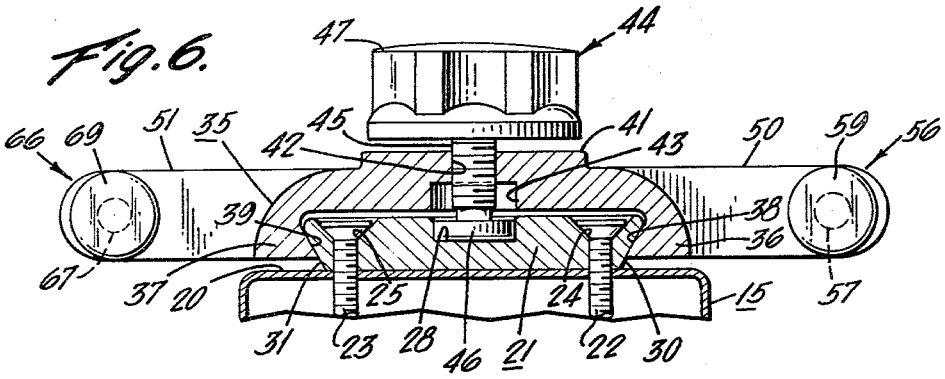
FIG. 6 is a fragmentary view in section, taken as indicated by the arrows 6—6 of FIG. 5.

Slidably disposed on the fixed plate 21, with capacity for fore-and-aft longitudinal adjustment, is a slide 35 of generally inverted U-shaped cross section (FIG. 6). The transversely spaced longitudinal edges of slide 35 are provided with elongated, depending flanges 36, 37, the smooth, sloping inner surfaces 38, 39 of which are of complemental inclination to the beveled edges 30, 31, respectively, of the fixed plate 21. The complemental surfaces 30, 38 and 31, 39 are snugly and slidably engageable, whereby slide 35 is securely retained on slide plate 21 with capacity for selected longitudinal movement. The arrangement permits slide 35 to be located at a plurality of selected positions relative to the slide plate 21, or to be removed entirely from plate 21, if necessary.

Disposed on the upper surface of slide 35 is a generally rectangular boss 41. Located centrally of boss 41 is a threaded hole 42 which extends downwardly to merge with an enlarged, preferably circular aperture 43 formed in the bottom of slide 35. The diameter of aperture 43 is equal to, or slightly larger than, the width of slot 28 formed in the upper surface of plate 21. The common axis of hole 42 and aperture 43 is perpendicular to the longitudinal axis of groove 28.

A locking means 44, in the nature of a set screw, has a threaded stem 45 threadingly engaged with the threads of hole 42. Affixed to the lower end of threaded stem 45 is a locking disc 46, and affixed to the upper end of stem 45 is a locking knob 47. The diameter of locking disc 46 preferably is substantially equal to the width of slot 28, whereby the disc is engageable snugly within the slot 28. The bottom surface of locking disc 46 is flat, to provide frictional engagement with the bottom of slot 28. By means of the threaded engagement between hole 42 and stem 45, knob 47 may be turned to advance disc 46 into locking contact with the bottom of slot 28, thereby locking slide 35 firmly into position relative to slide plate 21. Upon loosening the locking means 44, slide 35 may be adjusted longitudinally to any selected location relative to slide plate 21, whereupon locking means 44 again may be tightened, to secure the slide 35 in position relative to plate 21.

Figure 4:
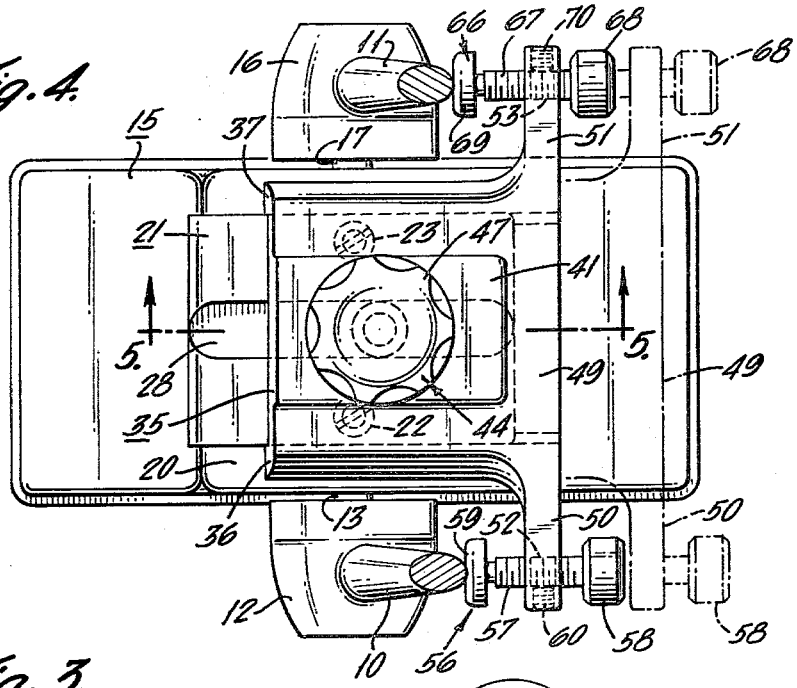
FIG. 4 is a fragmentary view in top plan.

Disposed at the forward end of slide 35 is a transverse yoke 49. In the embodiment shown, yoke 49 is formed integral with slide 35, but it will be understood that the two parts may be separate, and connected by any suitable means, such as threaded bolts. The yoke 49 is provided with a pair of transversely extending arms 50, 51. Formed in the distal end of each arm 50, 51, respectively, is a threaded aperture 52, 53 (FIG. 4).

Threadingly engaged in the apertures 52, 53, respectively, are transversely spaced throttle lever stops 56, 66. The throttle lever stop 56 includes a threaded stem 57 which engages threadingly with the threads of aperture 52. Affixed to the outer end of threaded stem 57 is a knob 58, and affixed to the inner end of stem 57 is an enlarged abutment 59, preferably in the form of a disc. By means of the threaded engagement between aperture 52 and stem 57, knob 58 may be turned to advance and retract abutment 59 relative to its yoke arm 50.

Similarly, throttle lever stop 66 includes a threaded stem 67 having a knob 68 affixed to its outer end and an enlarged abutment 69, in the form of a disc, affixed to its inner end. The threaded engagement between aperture 53 and stem 67 permits abutment 69, upon turning knob 68, to be advanced and retracted relative to its yoke arm 51.

If desired, set screws 60, 70 may be utilized to retain throttle lever abutments 59, 69 in any selected position to which they may be adjusted.

Figure 3:
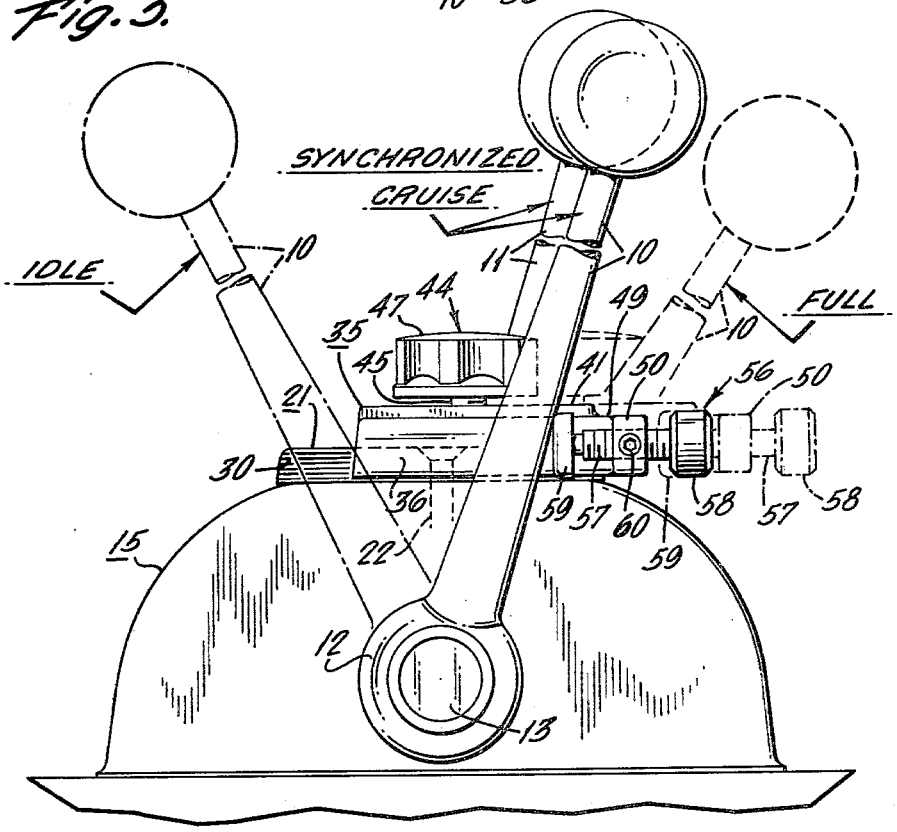
FIG. 3 is a fragmentary view in side elevation.
Figure 5:
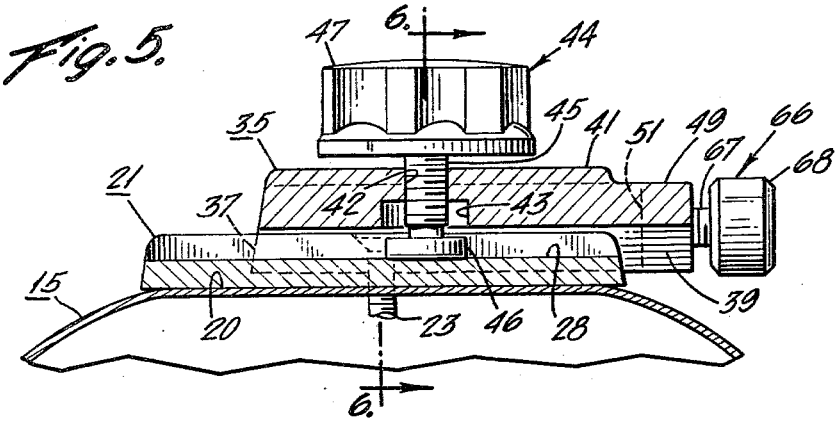
FIG. 5 is an enlarged fragmentary view in section, taken as indicated by the arrows 5—5 of FIG. 4.

As is best illustrated in FIGS. 1, 3 and 4, the abutments 59, 69 of the throttle lever stops 56, 66 are aligned longitudinally, respectively, with the throttle levers 10, 11. Thus, the throttle levers may be advanced into contact with the disc-like abutments 59, 69. The stops 56, 66 serve to limit the forward advance of the throttle levers 10, 11.

The throttle synchronizer illustrated in FIGS. 1–6, comprising fixed slide plate 21, adjustable slide 35, throttle lever stops 56, 66 and their various related parts, permits the throttle valve levers 10, 11 to be selectively advanced quickly, accurately and synchronously to any desired boat cruising speed location, to synchronize the engines and drive the boat at a selected cruising speed. In utilizing the throttle synchronizer, the slide 35 first is selectively positioned relative to slide plate 21, and then secured in place by tightening locking knob 47 of the locking means 44. This locates the throttle lever stops 56, 66 at positions permitting the throttle levers 10, 11 to be advanced into contact with abutments 59, 69 at the selected cruise speed setting, as illustrated by the solid line representations of the throttle levers in FIGS. 1, 3 and 4. Finite fore-and-aft axial adjustment of the throttle lever stops 56, 66 ensures that the individual advanced locations of the throttle levers 10, 11 are synchronous, to synchronize the engines to which they are connected. As will be readily understood, slide 35 and throttle lever stops 56, 66 may be adjusted longitudinally to a variety of throttle lever settings, for various boat cruising speeds, as desired.

When it is necessary to slow down a boat cruising at a selected speed, as in a marina, or when cruising through crowded waterways, passing docks or other boats, etc., it usually is necessary to throttle the engines back to slow or "idle" speeds, by retracting the throttle levers 10, 11 as illustrated in FIG. 2 and by the phantom illustration of throttle lever 10 in "idle" position in FIG. 3. By means of the throttle synchronizer of this invention, it is possible to quickly and accurately restore the speed of the boat from idling speed to the selected cruising speed, with complete, accurate and automatic synchronization of the engines, simply by again advancing the throttle levers 10, 11 to their selected boat cruising speed position, i.e. by advancing them once again into contact with the abutments 59, 69 of the throttle lever stops 56, 66.

In the event it is desired to operate the boat at speeds greater than normal cruising speeds, or at full speed, the locking knob 47 is loosened, the slide 35 advanced relative to slide plate 21, and then the locking knob tightened, thereby positioning slide 35 and its yoke 49 and throttle lever stops 56, 66 in the forward location illustrated by the phantom lines in FIGS. 3 and 4. Such adjustment permits the throttle levers 10, 11 to be advanced to a "full" speed position, as shown by the advanced illustration in phantom of throttle control lever 10 in FIG. 3.

Thus, the throttle lever stops 56, 66 accurately limit the forward advance of the two throttle levers 10, 11, after the throttle synchronizer has been properly set. By such arrangement, it is possible to restore the speed of the boat from slow or idling speed to cruising speed quickly and accurately, with complete and automatic synchronization of the two engines. Visual attention to the repositioning of the throttle levers 10, 11, upon returning them to cruising speed, is rendered unnecessary by this invention. The pilot of the boat is enabled to reset the throttles automatically to synchronized cruising speed without giving them his visual attention. He may devote his full atenttion to the water lane in which he is cruising, thereby providing enhanced safety in boat operation.

Figure 7:
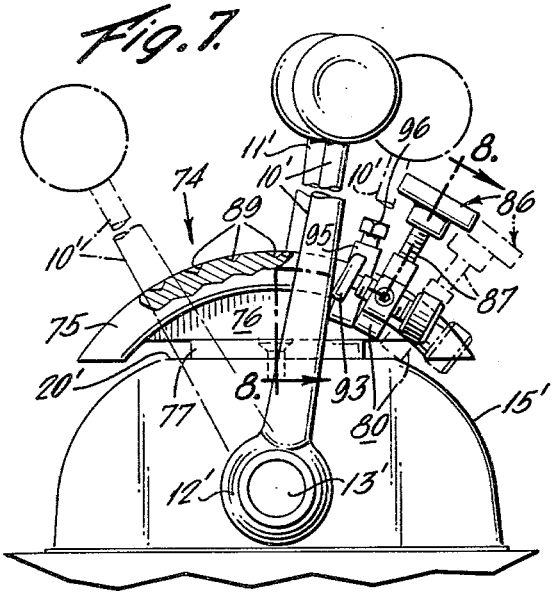
FIG. 7 shows a modification of the throttle synchronizer of this invention.
Figure 8:
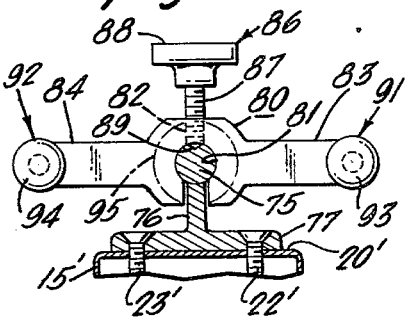
FIG. 8 is a fragmentary view in section, taken as indicated by the arrows 8—8 of FIG. 7.

In the modified throttle synchronizer of this invention illustrated in FIGS. 7 and 8, there are shown knobbed throttle valve control levers 10', 11', lever 10' being provided with hub 12' suitably secured to the outer end of rotatable stud shaft 13'. Throttle lever housing 15' has a flat upper surface 20', to provide a support for the modified throttle synchronizer.

Mounted on the flat housing surface 20' is a support 74 comprising a round, longitudinally extending, arcuate bar 75 having an integral medial support bracket 76 depending from its concave arc and terminating in a laterally extending support plate 77. Each outer end of plate 77 is provided with one or more apertures for the reception of transversely spaced bolts 22', 23', or similar means, for securing the support 74 firmly to the top of the throttle lever housing 15'. If desired, of course arcuate support bar 75 may be of tubular construction.

Disposed at the forward end of the support 74 is a transverse yoke 80. As shown in FIG. 8, yoke 80 is provided with a centrally disposed bore 81 for engaging slidably with the surface of the arcuate support bar 75, whereby yoke 80 may be mounted on the bar 75 with capacity for fore-and-aft axial or longitudinal adjustment. Formed centrally in the top of yoke 80 is a threaded aperture 82 which extends downwardly from the top of the yoke to open communication with the bore 81. The yoke 80 is provided with a pair of transversely extending arms 83, 84 having formed in their distal ends threaded apertures similar to the threaded apertures 52, 53 illustrated in FIG. 4.

The transverse yoke 80 is secured selectively in position on arcuate bar 75 by means of a set screw 86 having a threaded stem 87, to the upper end of which is affixed a lock knob 88. Stem 87 engages threadingly with the threads of aperture 82. The upper arcuate surface of bar 75 is provided with a plurality of uniformly spaced indentations 89 for the reception of the lower locking end of the threaded stem 87 of the set screw 86. The indentations 89 serve as detents, locking the yoke 80 in place on the arcuate support bar 75 by engagement of the lower end of threaded stem 87 within one of the indentations 89.

A pair of transversely spaced throttle lever stops 91, 92 are mounted in the distal ends, respectively, of the yoke arms 83, 84. Throttle lever stops 91, 92 are of similar construction to throttle lever stops 56, 66 illustrated in FIGS. 1–6. They serve the same purpose of limiting the forward advance of the two throttle levers 10', 11' into selected, synchronous cruising speed locations, to operate their respective engines at the speeds desired for powering the boat. The throttle lever stops 91, 92 include inwardly disposed disc-like abutments 93, 94 which are axially adjustable in the same manner as the abutments 59, 69 of the throttle lever stops 56, 66.

By reason of the set screw 86 and the several spaced indentations or detents 89, the yoke may be positioned and locked selectively on the bar 75, to thereby vary the selected cruising speed at which the boat may be operated.

If desired, a ring stop 95, mounted telescopically on arcuate support bar 75 and provided with a set screw 96, may be utilized to locate the axially moveable yoke 80 on the arcuate support bar 75. If it is desired to increase speed of the boat, set screw 86 of the yoke 80 may be released and the yoke advanced relative to the support bar 75, and then reset, as indicated by the shadow lines in FIG. 7. In that event, the throttle levers 10', 11' may be advanced to permit the engines to operate at full speed. Ring stop 95, firmly affixed to support bar 75 by set screw 96, and serving as a location means, will permit the quick and accurate return of the transverse yoke to its previous cruising speed location, when desired. Thus, with the modified arrangement illustrated in FIGS. 7 and 8, it is possible, by the throttle synchronizer of this invention, to quickly and accurately restore cruising speed of a boat, from either idling speed or fast speed, with complete, accurate and automatic synchronization of the speed of the two engines of the boat.

Although two preferred embodiments of this invention have been shown and described for the purpose of illustration, and the best mode of the invention has been taught, as required by Title 35 U.S.C. 112, it is to be understood that various changes and modifications may be made to the invention without department from the spirit and utility thereof, or from the scope of the invention as set forth in the appended claims.

We claim:

1. A throttle synchronizer for plural internal combustion engines, each engine having a separate throttle valve control lever mounted for selected forward and reverse longitudinal movement relative to a fixed location, said throttle synchronizer comprising (a) a support extending longitudinally in the direction of movement of the levers, (b) a transverse yoke mounted slidably on the support with capacity for selected longitudinal positioning relative to the support, (c) locking means for locking the yoke securely in a selected position on the support, (d) throttle lever stops mounted on the yoke, said stops limiting the forward movement of the levers, and (e) adjustment means for the throttle lever stops to permit the levers to be maintained in synchronous engine settings relative to each other, when the levers have been advanced into contact with the stops.

2. The throttle synchronizer of claim 1, wherein (a) the moveable levers are adapted to be advanced and retracted in a linear path of movement relative to the support and the yoke and (b) a separate stop is located in the path of movement of each lever.

3. The throttle synchronizer of claims 1 or 2, wherein (a) the support comprises a slide plate, (b) the yoke is mounted on a slide retained by the slide plate, said slide being slidable longitudinally relative to the slide plate, and (c) the locking means comprises a set screw, (d) said slide plate, slide and set screw being operative cooperatively to locate the stops mounted on the yoke at selected positions in the paths of movement of the levers.

4. The throttle synchronizer of claim 3, wherein (a) the slide plate is provided with an elongated longitudinal slot and (b) the set screw includes a locking disc engageable within the slot to lock the slide against movement relative to the slide plate.

5. The throttle synchronizer of claim 3, wherein the slide plate and the slide are provided with transversely spaced, complementally sloped, longitudinally extending, slidably engaged surfaces, whereby the slide is retained by the slide plate with capacity for slidable displacement relative to the slide plate.

6. The throttle synchronizer of claims 1 or 2, wherein (a) the support comprises an elongated bar and (b) the locking means comprises detent means, said detent means including (i) a plurality of spaced indentations formed in the bar and (ii) a set screw mounted on the yoke and adapted to be engaged with one of the indentations.

7. The throttle synchronizer of claim 6, wherein (a) the bar is round and of arcuate configuration and (b) the yoke is provided with a circular bore for engaging the yoke slidingly with the round surface of the bar, (c) said bar, slidable yoke and detent means being operative cooperatively to locate the stops mounted on the yoke at selected positions in the paths of movement of the levers.

8. The throttle synchronizer of claim 7, further including a stop mounted on the bar for locating the slidable yoke at a selected position relative to the bar.

9. A throttle synchronizer for a multi-engine boat, each engine of which has a separate throttle valve control lever mounted for selected fore-and-aft pivotal movement relative to a fixed housing, said throttle synchronizer comprising (a) a support mounted on the housing and extending longitudinally of the housing in the fore-and-aft direction of movement of the levers, (b) a transverse yoke mounted slidably on the support with capacity for selected longitudinal positioning relative to the support, whereby said slidable yoke is selectively adjustable relative to the fore-and-aft paths of movement of the levers, (c) throttle lever stops mounted on the yoke, each stop being located in the path of movement of one of the levers, whereby said stops limit the forward movement of the levers to a selected boat cruising speed location, (d) locking means for locking the yoke securely in a selected position on the support, said selected position establishing the selected boat cruising speed location for the levers, and (e) adjustment means for the stops to locate the stops selectively relative to the yoke, to permit the levers to be maintained in synchronous engine settings relative to each other when the levers have been advanced to the selected boat cruising speed location, (f) said throttle synchronizer providing means whereby the levers may be quickly and accurately advanced to a selected boat cruising speed location relative to the housing, with accurate and automatic synchronization of the engines of the boat at said boat cruising speed location.

* * * * *